United States Patent [19]

Mickelson et al.

[11] Patent Number: 4,767,255

[45] Date of Patent: Aug. 30, 1988

[54] BACKHOE BOOM CYLINDER BLEED CIRCUIT

[75] Inventors: Roger D. Mickelson, W. Burlington, Iowa; Thomas R. Brown, Plainfield, Ill.

[73] Assignee: J.I. Case Company, Racine, Wis.

[21] Appl. No.: 101,719

[22] Filed: Sep. 28, 1987

[51] Int. Cl.[4] ..... E02F 3/42

[52] U.S. Cl. ..... 414/695.5; 91/402; 414/719

[58] Field of Search ..... 414/685, 694, 695.5, 414/719; 91/402, 409

[56] References Cited

U.S. PATENT DOCUMENTS

| | | | |
|---|---|---|---|
| 3,376,984 | 4/1968 | Long et al. | 414/694 |
| 3,853,368 | 12/1974 | Eichelsheim | 91/402 X |
| 4,074,821 | 2/1978 | Long | 414/694 |
| 4,358,240 | 11/1982 | Shumaker | 414/694 |
| 4,718,325 | 1/1988 | Shore | 91/402 X |
| 4,728,251 | 3/1988 | Takashima et al. | 414/695.5 X |

*Primary Examiner*—Robert J. Spar
*Assistant Examiner*—P. McCoy Smith
*Attorney, Agent, or Firm*—Cullen, Sloman, Cantor, Grauer, Scott & Rutherford

[57] ABSTRACT

A bleed circuit for a backhoe boom cylinder which minimizes cylinder pressure during over-center movement of the boom while permitting the maintenance of sufficient cylinder pressure during other boom operations. The boom cylinder is provided with a retract port, a head end port, and a small bleed port with a bleed line connecting the bleed and head end ports. As the boom cylinder crosses over-center, the fluid pressure in the retract side of the boom cylinder may be transmitted from the rod end to the head end of the cylinder thereby reducing cylinder pressure and improving the over-center controlability of the boom.

1 Claim, 2 Drawing Sheets

BACKHOE BOOM CYLINDER BLEED CIRCUIT

BACKGROUND OF THE INVENTION

The present invention relates to a bleed circuit for a backhoe boom cylinder which minimizes cylinder pressure during over-center movement of the boom while permitting the maintenance of sufficient cylinder pressure during other boom operations.

A popular feature on backhoes for several years has been the over-center boom. This arrangement permits an over-center movement of the backhoe boom to a transport configuration wherein the center of gravity of the backhoe is closer to the rear of the transport vehicle. An arrangement of this type is disclosed in U.S. Pat. No. 3,376,984, which is assigned to the assignee of the present invention.

A typical procedure for bringing the backhoe boom over-center is to retract the boom cylinder until the boom cylinder reaches its over-center position. Then, the boom cylinder control valve is reversed and the boom continues its motion to an over-center position. The boom cylinder is retracted to provide sufficient velocity to the boom so that it continues its movement in response to kinetic energy, even after the boom cylinder reaches its over-center condition where the effective movement arm of the boom cylinder is lost. As the boom cylinder crosses over-center, its starts to extend. Hydraulic fluid in the retract side of the cylinder is locked in by the control valve for the boom cylinder until it is reversed. Thus, high boom cylinder pressures can be generated if the boom cylinder control valve reversals are not timed correctly. Moreover, the circuit relief valve does not provide pressure reduction in this over-center condition because it is set high to govern the lift capacity of the backhoe dipper arm.

Examples of prior art are shown in U.S. Pat. Nos. 3,054,384; 3,129,720; 3,272,085; 3,398,650; 3,523,490; 3,613,503; 3,668,975; 4,164,122; and Re. 28,695. However, none of these prior art patents are directed to minimizing cylinder pressure during the movement of a backhoe boom and cylinder arrangement over-center while maintaining pressure for other boom operations.

Therefore, the present invention is directed to a circuit for reducing backhoe boom cylinder pressure during over-center movement of the backhoe boom. Further, the present invention is directed toward improving the controlability of the backhoe boom since exact timing for reversing the boom cylinder control valve becomes less critical. Moreover, the present invention is directed toward limiting the range of the boom position to that segment of the total travel arc which is most useful for lifting purposes.

SUMMARY OF THE INVENTION

In accordance with the present invention, a backhoe arrangement is provided including a boom pivotally mounted to a swing tower and a boom cylinder pivotally connected between the boom and the swing tower. The boom cylinder is of a double-acting type such that extension and retraction of the cylinder piston rod results in pivotal movement of the boom relative to the swing tower.

The piston rod within the boom cylinder includes a head end having a ring or seal thereon which wipes the interior of the cylinder. The cylinder is provided with a retract port and a head end port. A small bleed port is provided along the length of the cylinder near the head end port. Further, a bleed line permits fluid communication between the ports when the boom cylinder approaches its over-center position. Pressurized fluid is directed to the retract port for retracting the piston rod while pressurized fluid is directed to the head end port for extending the piston rod. A manually operable valve unit is provided to control the direction of fluid flow to either the retract port or the head end port.

When the boom is in a working position, it extends rearwardly and the piston seal is positioned to one side of the bleed port which prevents fluid communication between the rod and head ends of the boom cylinder. If the control valve is actuated such that fluid pressure is directed to the retract port of the boom cylinder, the boom is swung to a position slightly forward of vertical wherein its momentum enables continued movement to an over-center transport position. As the boom cylinder crosses over-center, it begins to extend and hydraulic fluid in the retract side of the cylinder is locked in by the boom cylinder control valve until the valve is reversed. Upon reversal of the control valve, fluid pressure is applied to the head end port of the boom cylinder to assist the travel of the boom over-center.

As the boom cylinder crosses over-center, the piston seal is positioned between the bleed and head end ports which permit fluid pressure communication between the rod and head ends of the boom cylinder. This permits the pressure in the retract side of the cylinder to be reduced. This also improves the over-center controlability of the boom since exact timing for reversing the control valve is not as critical because the pressure in the retract side of the cylinder has been reduced. Moreover, the fluid pressure for other boom operations is maintained since the fluid pressure communication between the rod and head ends does not occur when the boom is in a working position.

The present invention additionally assures that an operator will not erroneously position the boom near the over-center position where the boom cylinder does not have a sufficient moment arm to support a load during lifting operations. That is, the fluid pressure communication between the rod and head ends of the boom cylinder continues until the boom is in a position such that there is a sufficient moment arm for lifting. If this feature was not present, the pressure in the boom cylinder could exceed the circuit relief pressure thereby resulting in a leak down or partial collapse under load. Thus, the present construction assists in assuring that the boom is positioned at that segment of the travel arc which is most useful for lifting purposes.

Other advantages and meritorious features of the present invention will be more fully understood from the following description of the invention, the appended claims, and the drawings, a brief description of which follows.

DETAILED DESCRIPTION OF THE INVENTION

Figure 1:
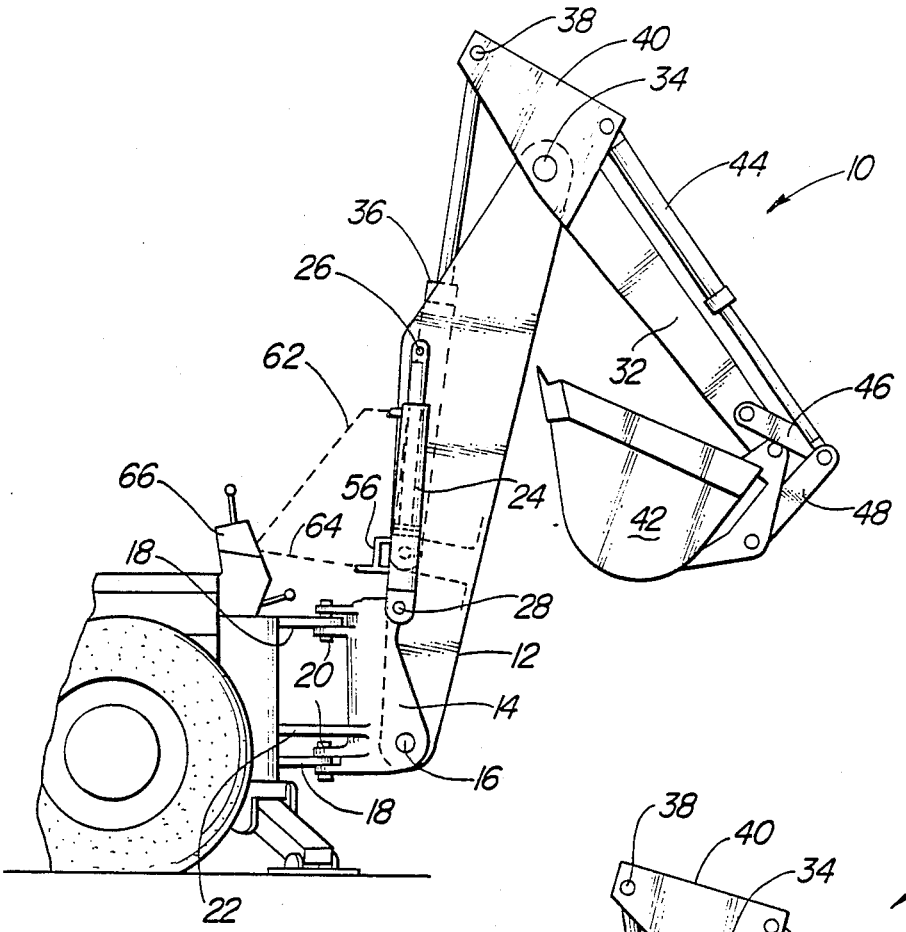
FIG. 1 is a side elevational view of a backhoe including the boom cylinder bleed circuit of the present invention wherein the backhoe is in a working position.

A backhoe assembly 10 including the bleed circuit of the present invention is illustrated in FIGS. 1–6.

As is conventional, a boom 12 is pivotally mounted to swing tower 14 by means of pin 16. The swing tower 14 is pivotally mounted to rearwardly projecting tractor mounting brackets 18 by means of upper and lower pins 20 which define a vertical axis. A swing cylinder 22 is provided for positioning the swing tower 14 about the vertical axis defined by pins 20. At least one boom cylinder 24 is pivotally connected at one end to boom 12 by pin 26 and at its opposite end to swing tower 15 by pin 28. The boom cylinder 24 is of a double-acting type and has its piston rod 30 pivotally connected upon pin 26 towards the free end of boom 12.

A dipper 32 is pivotally attached to one end of boom 12 by pin 34. The dipper 32 is pivoted about the axis of pin 34 by the extension and retraction of cylinder 36 which is mounted between boom 12 and pin 38 on plate 40. A bucket 42 is pivoted to the free end of dipper 32 in the conventional way. Bucket 42 is manipulated by bucket cylinder 44 which is pivotally connected between plate 40 and drive links 46 and 48.

Figure 4:
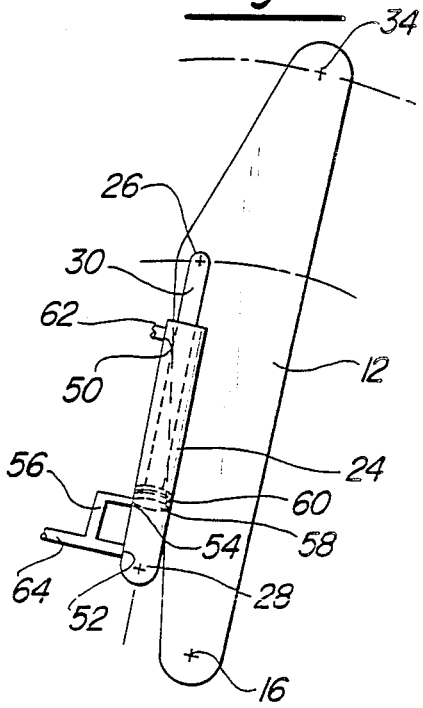
FIG. 4 is a fragmentary side elevational view of the boom and boom cylinder in a position similar to that of FIG. 1.
Figure 5:
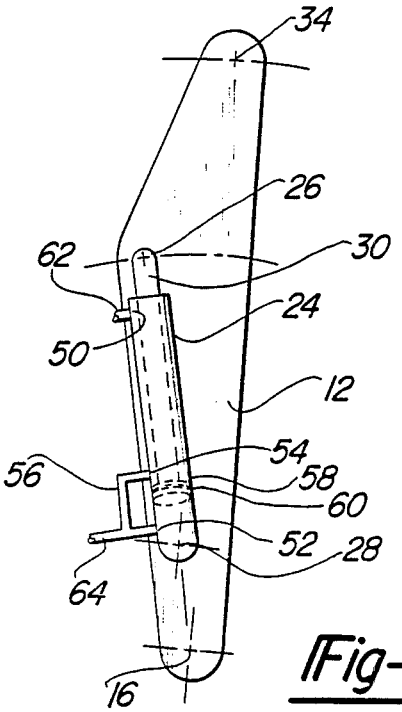
FIG. 5 is a fragmentary side elevational view of the boom and boom cylinder in a position similar to that of FIG. 2.
Figure 6:
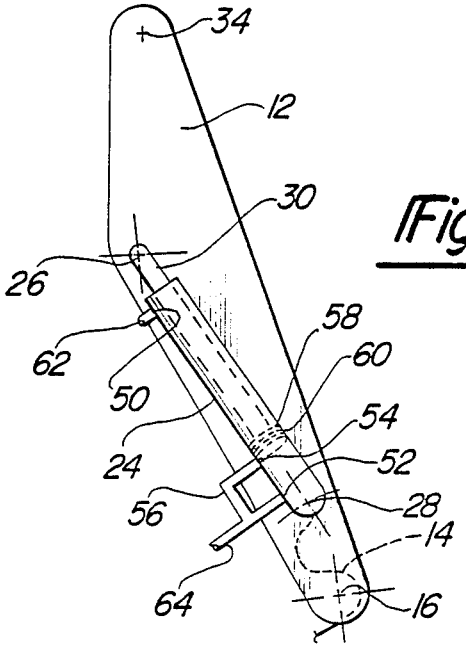
FIG. 6 is a fragmentary side elevational view of the boom and boom cylinder in a position similar to that of FIG. 3.

The present invention provides a bleed circuit which is connected between the boom cylinder head end and its retract end when the boom cylinder approaches its over-center position. Referring now to FIGS. 4–6, boom cylinder 24 is provided with a retract port 50 and a head end port 52. A small bleed port 54 is provided along the length of cylinder 24 near the head end port 52. A bleed line 56 permits fluid communication between ports 52 and 54, as will be described.

Piston rod 30 includes a head 58 having a ring or seal 60 thereon which wipes the interior of boom cylinder 24 in response to extension and retraction of piston rod 30. Pressurized fluid is directed through line 62 and port 50 for retracting piston rod 30 while pressurized fluid is directed through line 64 and port 52 extending piston rod 30. A manually operable valve unit 66 is provided on the tractor to control the direction of fluid flow through lines 62 and 64.

Figure 2:
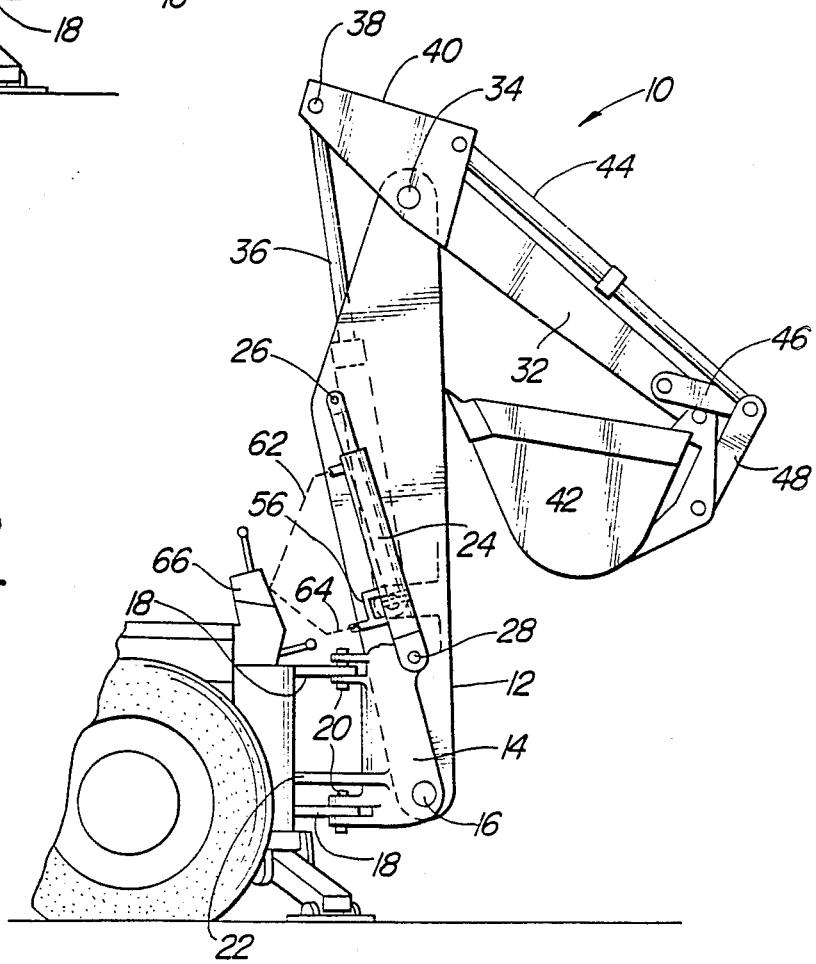
FIG. 2 is a side elevational view of the backhoe wherein the boom is swung to a position slightly forward of vertical.
Figure 3:
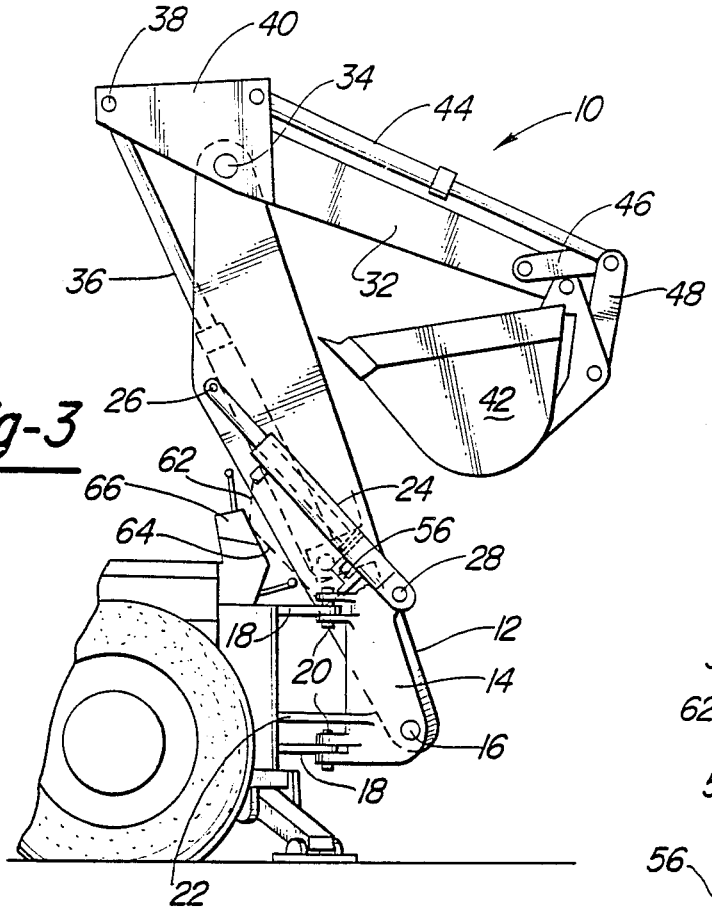
FIG. 3 is a side elevational view of the backhoe in an over-center transport position.

FIGS. 1 and 4 illustrate the boom 12 and boom cylinder 24 in a working position. In this position, the boom 12 extends rearwardly and the piston seal 60 is positioned above bleed port 56, as viewed in FIG. 4, which prevents fluid communication between the rod and head ends of cylinder 24. FIGS. 2 and 5 illustrate the boom 12 and boom cylinder 24 after control valve 66 is actuated such that fluid pressure is applied through line 62 and retract port 50 to the rod end of boom cylinder 24. The swings boom 12 to a position slightly forward of vertical wherein the momentum of the parts enable boom 12 to continue through the FIG. 5 position towards the FIG. 6 position. Control valve 66 is then reversed such that fluid pressure is applied through line 64 and port 52 to the head end of cylinder 24 to assist the forward travel of the boom 12 from the FIG. 5 to the FIG. 6 position. In the FIG. 5 position, piston seal 60 is positioned between ports 52 and 54 which permits fluid communication between the rod and head ends of cylinder 24. FIGS. 3 and 6 illustrate the boom 12 in its transport position where piston seal 60 is shown as being above port 54, as viewed in FIG. 6, which would prevent fluid cummunication between the rod and head ends of cylinder 24. In the transport position, however, piston seal 60 may be positioned on either side of port 54.

As boom cylinder 24 crosses over-center (FIGS. 5 and 6), piston rod 30 is extended which compresses the fluid in the retract side of the cylinder before control valve 66 is reversed. However, with the present arrangement, including bleed port 54 and bleed line 56, the pressure in the retract side of cylinder 24 is permitted to be reduced when cylinder 24 is near its over-center position, as shown in FIG. 5. In the position of FIG. 5, fluid pressure is transmitted from the rod end to the head end of cylinder 24 thereby improving the over-center controlability of boom 12 since exact timing for reversing control valve 66 is not as critical because the pressure in the retract side is reduced. Moreover, since the fluid pressure communication between the rod and head ends does not occur when the boom is in a working position, such as shown in FIG. 4, fluid pressure for other boom operation is maintained.

Further, the present invention assists in preventing a position of boom 12 near the over-center position where the boom cylinder 24 does not have sufficient moment arm to support a load during a lifting operation. As the boom cylinder 24 crosses over-center (FIGS. 5 and 6), fluid pressure is transmitted from the rod end to the head end of cylinder 24 until boom 12 is in a position such that there is a sufficient moment arm to permit the boom to support the load for which the machine is rated. This reduces the possibility of a leak down or partial collapse in the boom cylinder 24 should the pressure in the boom cylinder exceed the circuit relief pressure.

It will be apparent to those skilled in the art that the foregoing disclosure is exemplary in nature, the invention being defined by the appended claims.

What is claimed is:

1. In a backhoe arrangement including a boom pivotally mounted to support structure, a boom cylinder pivotally connected between said support structure and said boom, said boom cylinder having an extensible and retractable rod with a piston head on one end thereof, said piston head having a seal for defining a rod end portion of the cylinder and a head end portion of the cylinder, said boom cylinder further having a rod end port and a head end port, and a control valve connected to said rod end and head end ports for directing pressurized fluid to one or the other port, the improvement comprising:

a bleed port in said boom cylinder near said head end port, and a bleed line connecting said bleed port to said head end port;

said boom and boom cylinder movable to a working position where said piston head seal is located between said rod end and bleed ports for preventing fluid communication between the rod and head end portions of the cylinder;

said boom and boom cylinder movable to a generally over-center position in response to actuation of said control valve for directing fluid pressure through said rod end port wherein said piston head seal is located between said bleed and head end ports for permitting fluid pressure transmission between the rod and head end portions of the cylinder; and said boom and boom cylinder movable to an over-center transport position in response to reverse actuation of said control valve for directing fluid pressure through said head end port wherein said piston head seal is located between said rod and head end ports.

* * * * *